US005673791A

United States Patent [19]

Jamison

[11] Patent Number: 5,673,791

[45] Date of Patent: Oct. 7, 1997

[54] CONTAINER AND LID FOR CONTAINER

[75] Inventor: Barry Jamison, Fairfield, Ohio

[73] Assignee: Buckhorn Material Handling Group, Inc., Milford, Ohio

[21] Appl. No.: 317,563

[22] Filed: Oct. 4, 1994

[51] Int. Cl.[6] ..... B65D 21/032; B65D 21/036; B65D 21/06; B65D 43/16

[52] U.S. Cl. ..... 206/508; 206/511; 206/518; 220/329; 220/333; 220/334; 220/558

[58] Field of Search ..... 206/506, 507, 206/508, 511, 518; 220/333, 329, 334, 558

[56] References Cited

U.S. PATENT DOCUMENTS

| | | | |
|---|---|---|---|
| 1,234,072 | 7/1917 | Northover . | |
| 1,682,885 | 9/1928 | Butler . | |
| 2,897,999 | 8/1959 | Bishop | 220/29 |
| 3,261,651 | 7/1966 | Prowse | 312/290 |
| 3,303,949 | 2/1967 | Nickel et al. | 214/83.3 |
| 3,463,345 | 8/1969 | Bockenstette | 220/29 |
| 3,655,088 | 4/1972 | Box | 220/29 |
| 4,161,261 | 7/1979 | Frater | 220/337 |
| 4,288,134 | 9/1981 | Knaack et al. | 312/290 |
| 4,364,489 | 12/1982 | Alexeeff | 220/334 |
| 4,412,616 | 11/1983 | Williams | 206/333 |
| 4,432,467 | 2/1984 | Swingley, Jr. | 220/334 |
| 4,620,644 | 11/1986 | Miller | 206/508 X |
| 4,685,567 | 8/1987 | Webb | 206/506 |
| 4,688,675 | 8/1987 | Miller et al. | 206/508 |
| 4,765,480 | 8/1988 | Malmanger | 206/506 |
| 4,896,070 | 1/1990 | Reid et al. | 312/290 |
| 5,038,937 | 8/1991 | DiSesa, Jr. | 206/501 |
| 5,238,115 | 8/1993 | Schafer | 220/558 X |
| 5,360,114 | 11/1994 | Weidt | 220/333 X |

FOREIGN PATENT DOCUMENTS

| | | | |
|---|---|---|---|
| 577872 | 1/1994 | European Pat. Off. | 220/558 |
| 2686061 | 7/1993 | France | 220/334 |
| 2241492 | 9/1991 | United Kingdom | 220/334 |

*Primary Examiner*—Sue A. Weaver
*Attorney, Agent, or Firm*—Fay, Sharpe, Beall, Fagan, Minnich & McKee

[57] ABSTRACT

A container has a drop gate and lids that open along hinge joints formed at the upper end of the side walls. The drop gate is formed in one end wall and the lids can also be opened half way from the end wall in which the drop gate is formed. In this way, access to the interior of the container can be gained through the open drop gate and the open half of the lids so that the container can be used as a shelf box or hopper in a flow racking system. Further, when the lids are opened along their respective side wall hinge joints, the container can be used as a distribution tote. When the container is also used as a bulk shipper by vendors or suppliers, the container can perform three functions in a distribution system. Specifically, the container can be first used as a bulk shipper, then, without unpacking the goods, the container can be shelved on a flow racking system from which orders can be selected at a distribution center. Finally, the container can be used again for shipping the goods from the distribution center to retail outlets and returned to either the distribution center or suppliers in a nested stack.

12 Claims, 19 Drawing Sheets

CONTAINER AND LID FOR CONTAINER

FIELD OF THE INVENTION

The invention relates to a container having a lid that can be used in a distribution system involving shipping, storing and displaying of goods, and in particular to a container that can be used as a shelf box in a flow racking system in a warehouse distribution center, as well as a distribution tote for shipping goods to retail outlets from a distribution center.

BACKGROUND OF THE INVENTION

A typical merchandise distribution operation involves a distribution center or warehouse that receives bulk shipments from vendors or suppliers. The goods are shipped by the suppliers to the distribution center in bulk shippers or bulk shipment containers. At the distribution center, the goods are unpacked from the bulk shippers and placed in hoppers, shelf boxes or similar containers arranged in a flow racking system.

In the distribution center, orders for goods that are to be sent to the retail outlets are filled by picking or selecting goods from the hoppers in the flow racks. Specifically, each hopper or container in the flow racking system has one kind of item, and the orders are filled by selecting one or more of each of the items from the shelf boxes or hoppers set in the flow racks. As the items are removed, they are packaged in outgoing distribution totes, which are then shipped to the retail outlets where they are unpacked or displayed on shelving from which the consumer can select the items for purchasing.

In the prior art distribution operation, several containers are required. Specifically, a bulk shipping container is used by the vendors or suppliers to ship their goods to the distribution center or warehouse. In the distribution center, the bulk shipped goods are unpacked to provide individual items that are loaded into the shelf boxes or flow rack hoppers. Then, outgoing distribution totes are used to ship the items selected from the flow racking system that are sent to the retail outlets. Accordingly, at each stage of the process, new containers are required and manual labor is involved in the repackaging of the goods from one container to the next. Thus, the typical distribution operation is labor intensive, and requires the use of many different types of specialized containers.

SUMMARY OF THE INVENTION

It is an object of the present invention to reduce the labor involved in providing an efficient distribution system of goods that extends from the supplying of goods by the supplier to the distribution of the goods to the retail outlets by eliminating the repacking of suppliers' goods at the distribution center into flow rack hoppers and by eliminating the need for handling and maintaining separate sets of flow racking and retail distribution containers.

It is a further object of the invention to reduce the number of containers that are required for an efficient distribution system of goods by providing a container that meets the shipping needs of the suppliers' delivery system, the flow racking needs of the distribution centers' flow racking system, and the distribution and merchandising display needs of the retail outlets. In particular, it is an object of the invention to provide a container that can be used to bulk ship goods to a distribution center, and that can be used in an order picking or flow racking system at the distribution center from which the goods are selected to fill an order.

It is a further object of the invention to provide a container that can be used not only for bulk shipping of goods to the distribution center, but also for shipping goods to the retailer. The lidded container can also be used in a retail outlet by opening the lids of the container to allow merchandising display of the goods on a shelf, a rack or on the floor, if the goods are not unpacked and placed on shelves.

It is yet another object of the invention that the container be provided with a lid that enables full containers to be stacked when the lids are closed and empty containers to be stacked in nested relationship (three to one nesting) when the lids are opened.

In order to provide the lidded container with these and other features of the invention, the lids can be fully opened or closed to provide stacking and nesting in a similar manner to conventional distribution totes and also opened part of the way, without increasing the overall dimension of the container for using the container as a hopper or shelf box in a flow racking or order picking system. For order picking, it is also a feature of the invention to provide the container with one or more walls that can be partially opened to permit access to the goods contained therein through the opening without substantially increasing the overall side to side (horizontal) or top to bottom (vertical) dimensions of the container.

By the present invention, the lids of the container can be opened in a conventional manner in one direction to permit full access to the interior, for example by hinging the lids along the side walls of the container. Further, according to the invention, half sections of the lids can be opened from one end wall in another direction along a mid portion hinge line and folded back on the other half sections of the lids to open one half of the container. With the container's lids opened half way in this manner, items can be picked or selected from the container when the container is used in an order picking or flow rack. Further, by providing a drop gate that can be opened from the same end wall from which the lids are opened half way, additional access to the interior of the container can be obtained for an order picking operation.

Further, in accordance with the present invention, the lids can be opened half way, and the container end wall opened partially through a drop gate, for example, without increasing the overall dimension of the container. In this way, maximum side-by-side racking density of the containers can be achieved, and also maximum vertical racking density of the containers can be achieved. These are critical requirements to be met when using the container in a flow racking system. Incidentally, since the drop gate hangs downwardly in front of the containers, neither the side-by-side nor the vertical racking density of the containers is affected, yet greater access to the interior of the container can be gained which may be desirable in certain instances.

BRIEF DESCRIPTION OF THE DRAWINGS

FIG. 8(*b*) is a front elevational view of the drop gate of FIG. 8(*a*) without the latches; and FIG. 8(*c*) is a cross sectional view of the drop gate shown in FIG. 8(*b*) taken along lines 8—8;

FIGS. 12(*b*) and 12(*c*) are opposite side views of the lid piece shown in FIG. 12(*a*); and FIG. 12(*d*) is an end view of the lid piece shown in FIG. 12(*a*);

FIGS. 13(*b* 13(*c*) are opposite side views of the lid piece shown in FIG. 13(*a*); and FIG. 13(*d*) is an end view of the lid piece shown in FIG. 13(*a*);

FIG. 14(*b*) is a side view of the lid piece shown in FIG. 14(*a*); and FIG. 14(*c*) is an end view, partly in section, of the lid piece shown in FIG. 14(*a*);

FIG. 15(*b*) is a side view of the lid piece shown in FIG. 15(*a*); and FIG. 15(*c*) is an end view, partly in section, of the 1 piece shown in FIG. 15(*a*);

FIG. 16(*b*) is an end view of the hinge member shown in FIG. 16(*a*).

DETAILED DESCRIPTION OF THE PREFERRED EMBODIMENTS

The invention is directed to a container having a drop gate and also to lids for a container, optionally having a drop gate.

Figure 1:
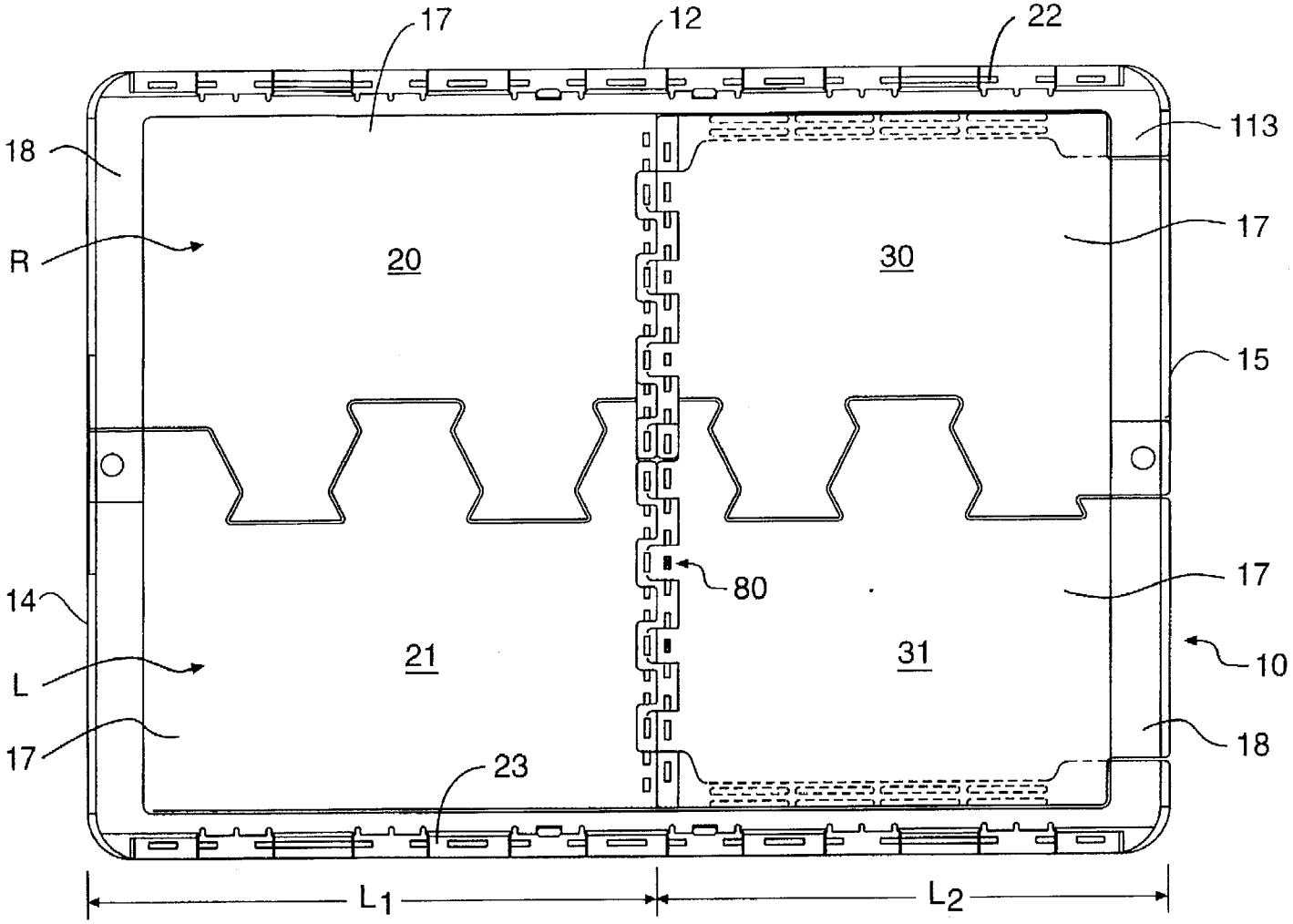
FIG. 1 is a plan view of the container constructed according to an embodiment of the present invention with lids constructed according to an embodiment of the present invention shown in their closed position covering the open top of the container.
Figure 2:
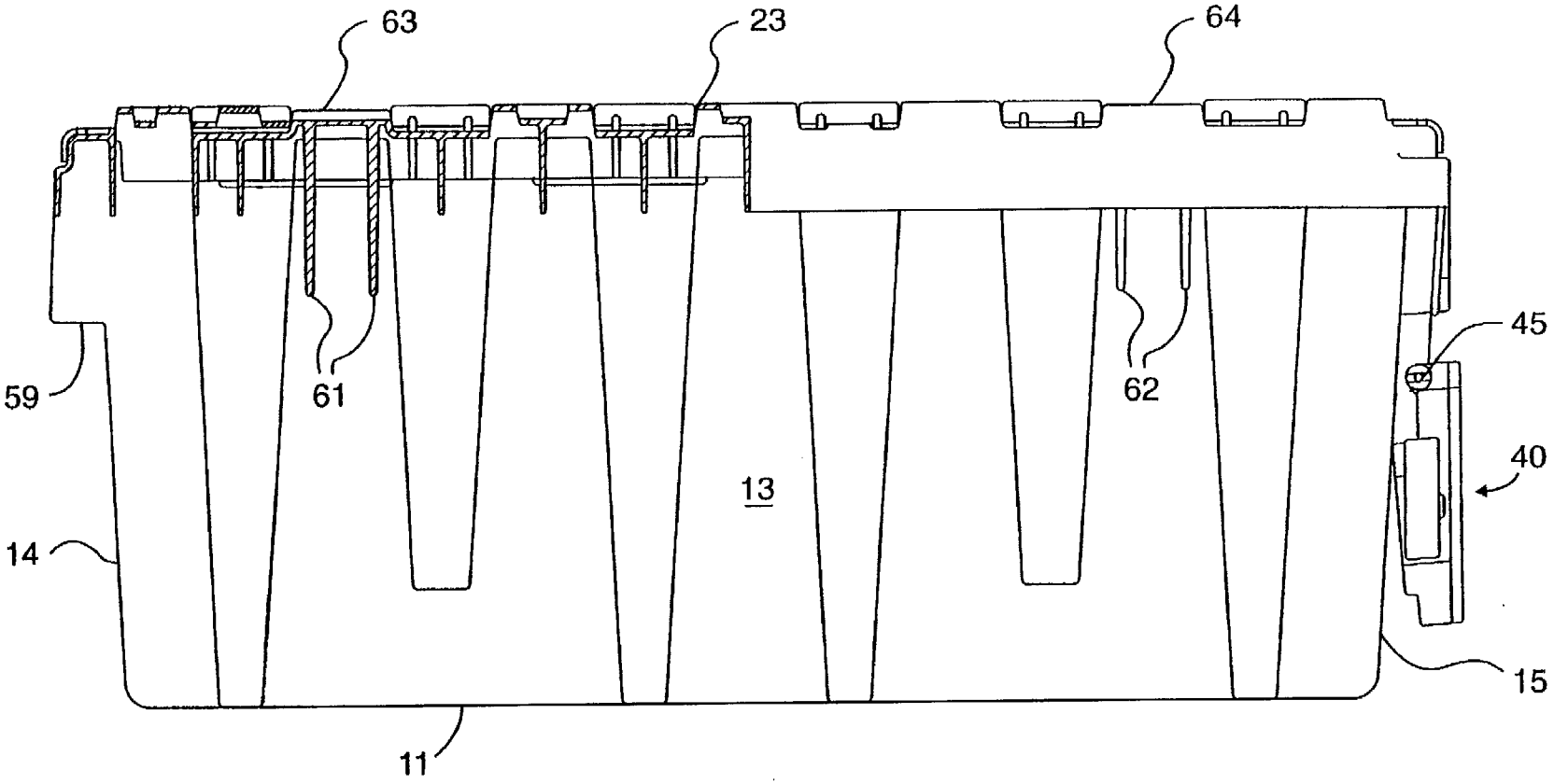
FIG. 2 is a side elevation of the lidded container of FIG. 1.
Figure 3:
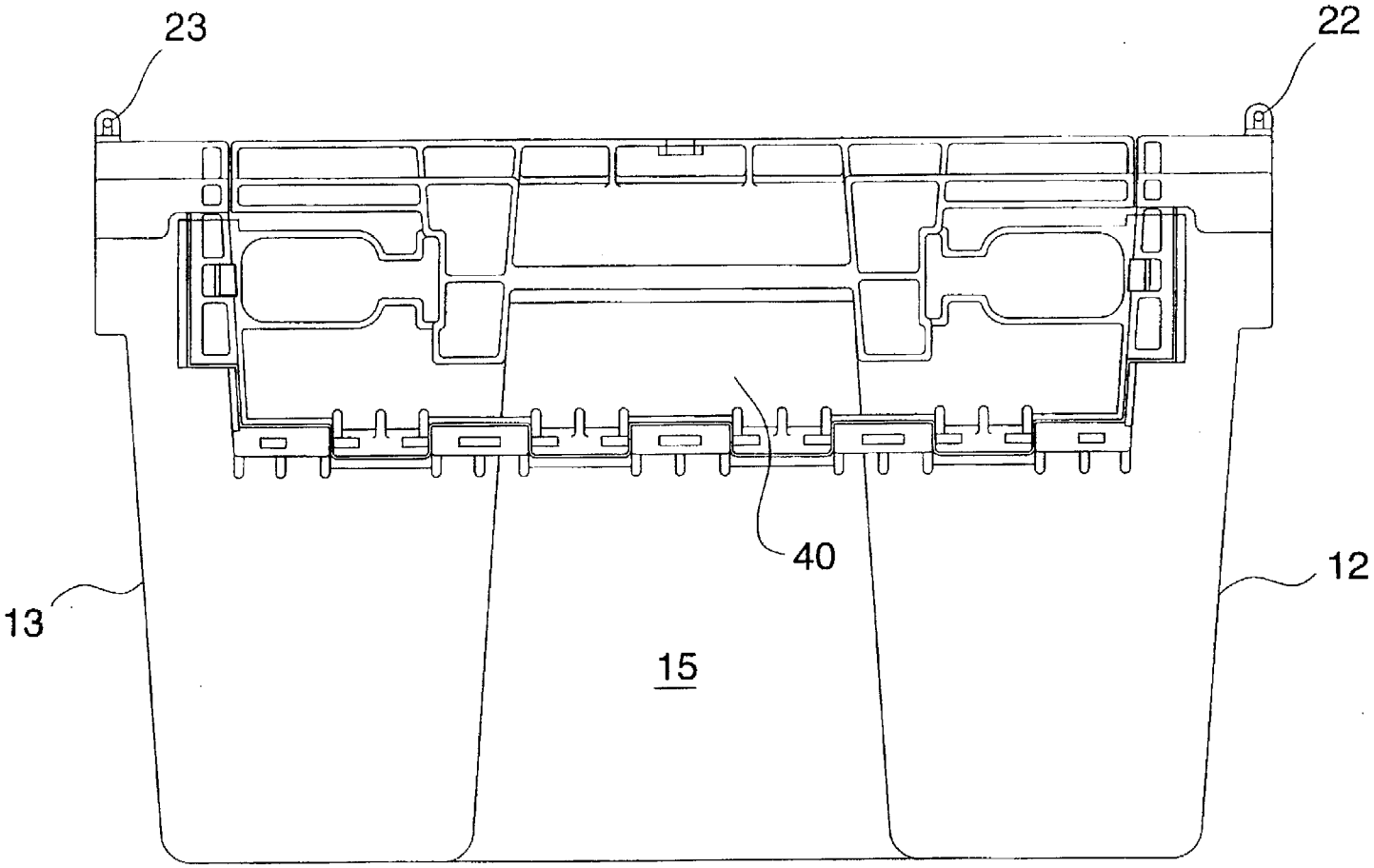
FIG. 3 is an end elevation of the lidded container shown in FIG. 1.

FIGS. 1–3 show a container 10 constructed according to an embodiment of the present invention. The container has a bottom wall 11, opposite side walls 12 and 13, opposite end walls 14 and 15 connected together and extending upwardly to form an open top. The top is covered by right and left lids, designated R and L, respectively. Lids R and L are hinged to side walls 12 and 13, respectively. In the open position, the lids hang down in overlapping relation with the respective side walls and in the closed position, shown in FIG. 1, the lids are interlocked through a series of fingers and pockets. A container having two lids is known as a tote box, or a distribution tote. In the closed position of the lids, the containers can be stacked on one another several high without damaging the goods contained therein. When the containers are empty, they can be stacked together in nested relation with the lids fully opened.

According to the present invention, lids R and L are not formed in single pieces. Rather, lid R is formed of a full lid piece 20 and a half lid piece 30. Similarly, lid piece L is also formed of a full lid piece 21 and a half lid piece 31. The right and left side lid pieces differ in construction, but are similar in detail. As shown, lid half 30 of lid R is hinged to full lid 20, and likewise half lid 31 is hinged to the full lid piece 21.

Figure 4:
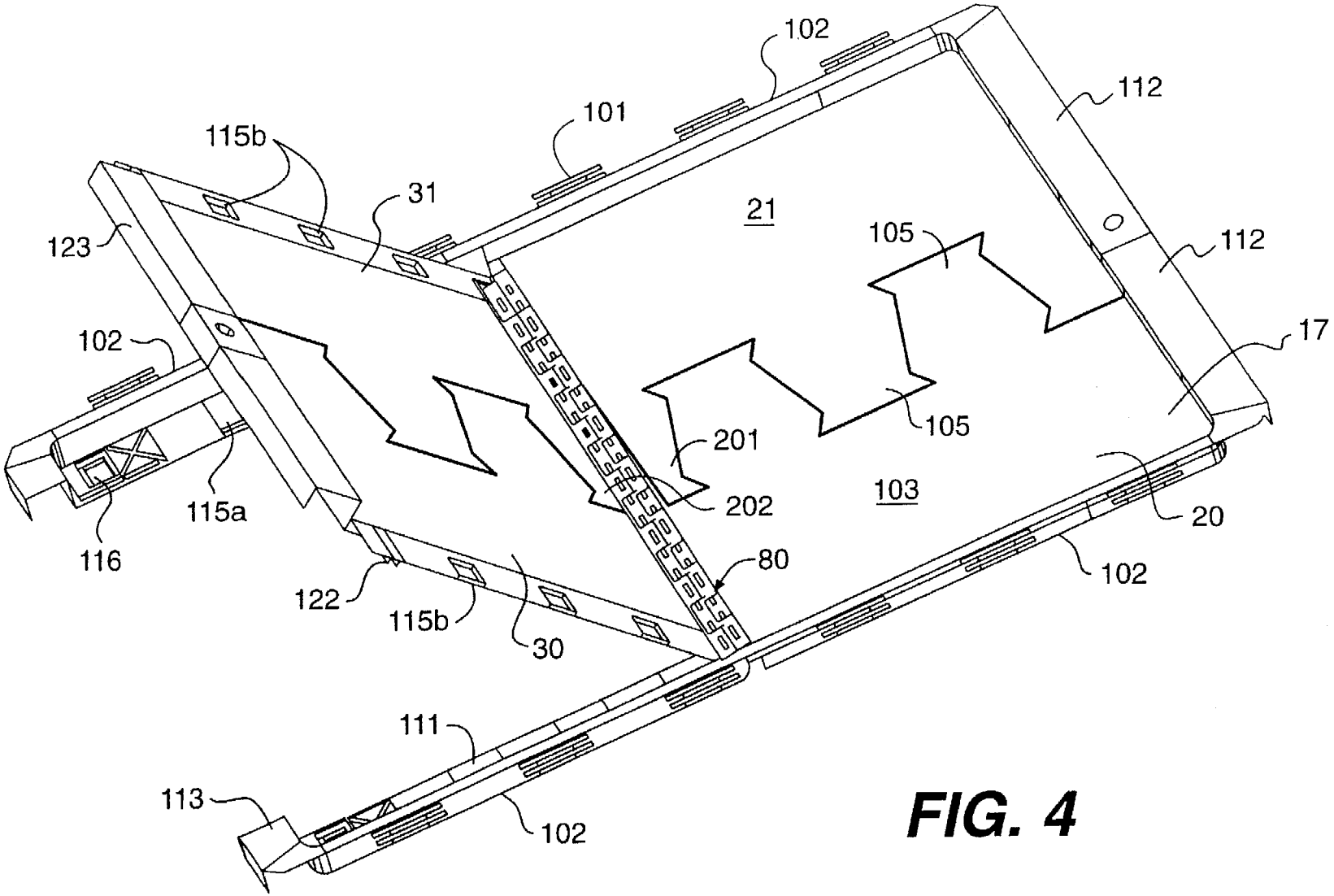
FIG. 4 is a perspective view of the lids shown in FIG. 1 wherein the half lid pieces are shown in a partially opened position.

Conventional distribution totes are well known, and typically have lids hinged to the side walls that are rotatable about the respective hinge joints approximately 270° between the fully closed position and an open position wherein the lids hang down along the side walls. When the full and half lid pieces 20, 30 and 21, 31 are fixed in substantially coplanar relation with each other, as shown in FIG. 1, lids R and L operate in a manner similar to a conventional distribution tote by permitting the lids to be rotated approximately 270° about respective hinge joints 22 and 23. According to the invention, however, as shown in FIG. 4, half lid pieces 30, 31 can be rotated about their respective hinge joints approximately 180° (not shown) to permit one end of the container to be opened without moving the lids with respect to hinge joints 22 and 23. This permits access to the interior of the container 10 without opening the lids in the conventional manner.

Further, in accordance with the invention, as shown in FIGS. 2 and 3, one end wall 15 is provided with a drop gate 40 that can swing between the fully closed position shown in FIG. 3 to the open position shown in FIG. 2, wherein the drop gate 40 hangs down to overlap end wall 15. Drop gate 40 is provided at the end of the container where half lids 30, 31 can be opened. By opening drop gate and half lids 30, 31 the lidded container of the invention is suitable for use in a flow racking system as a shelf box or hopper from which goods can be selected in an order picking operation.

As shown in FIG. 1, lid halves 30, 31 have an overall side to side dimension that is less than the side to side dimension of full lid pieces 20, 21 and that is preferably about the same as the width of the recessed portion 17 of the lids. Further, the length dimension ($L_2$) of the lid pieces 30, 31 is less than that ($L_1$) of the lid pieces 20, 21. By this arrangement, the half lid pieces 30, 31 can be rotated approximately 180° to a position, not shown, wherein the half lid pieces are substantially overlapping full lid pieces 20, 21 and wherein the overlap is confined within the recessed portion 17 of the lid pieces 20, 21. As a result, one half of container 10 can be opened without substantially increasing the overall vertical dimension of the container. This is an important consideration when using the container in a flow racking system wherein maximum vertical density is required to insure system efficiency. Also, maximum horizontal racking density can be achieved when the container is opened without increasing the width wise dimension of the container, which would result if a conventional distribution tote were opened to gain access to the interior of the container, i.e. with the lids hanging down along the side walls of the container.

Figure 5:
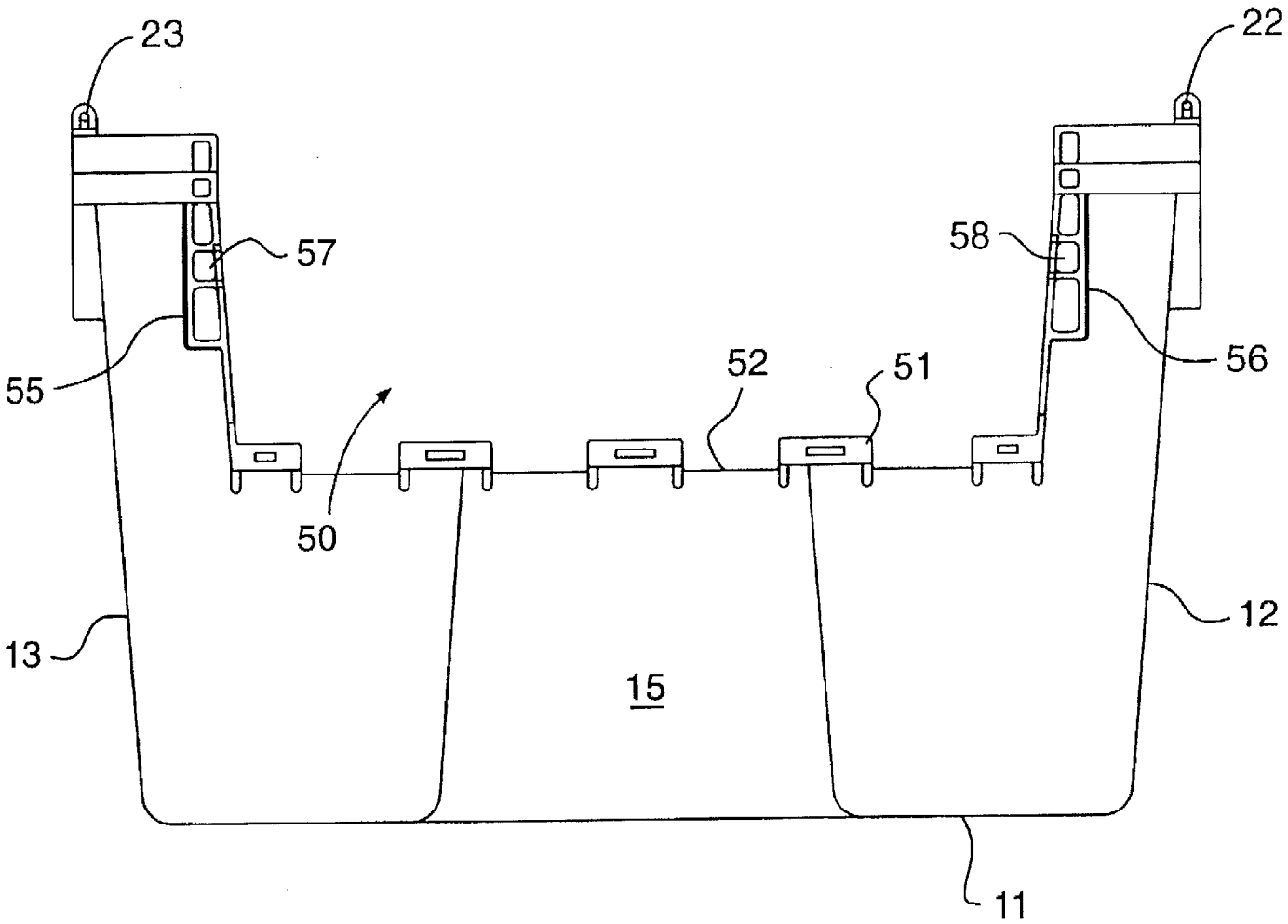
FIG. 5 is an end elevation of the container shown in FIG. 1 without the lids and without the drop gate being attached to the end wall.

The drop gate 40, which is included in the preferred embodiment, provides greater access through an opening 50, shown in FIG. 5, in the container end wall 15. Further, although the end wall to end wall dimension is increased by opening the drop gate 40, the increase in dimension is not significant since it doesn't affect the vertical or horizontal dimensions, which are critical to achieving maximum flow racking density.

Figure 6:
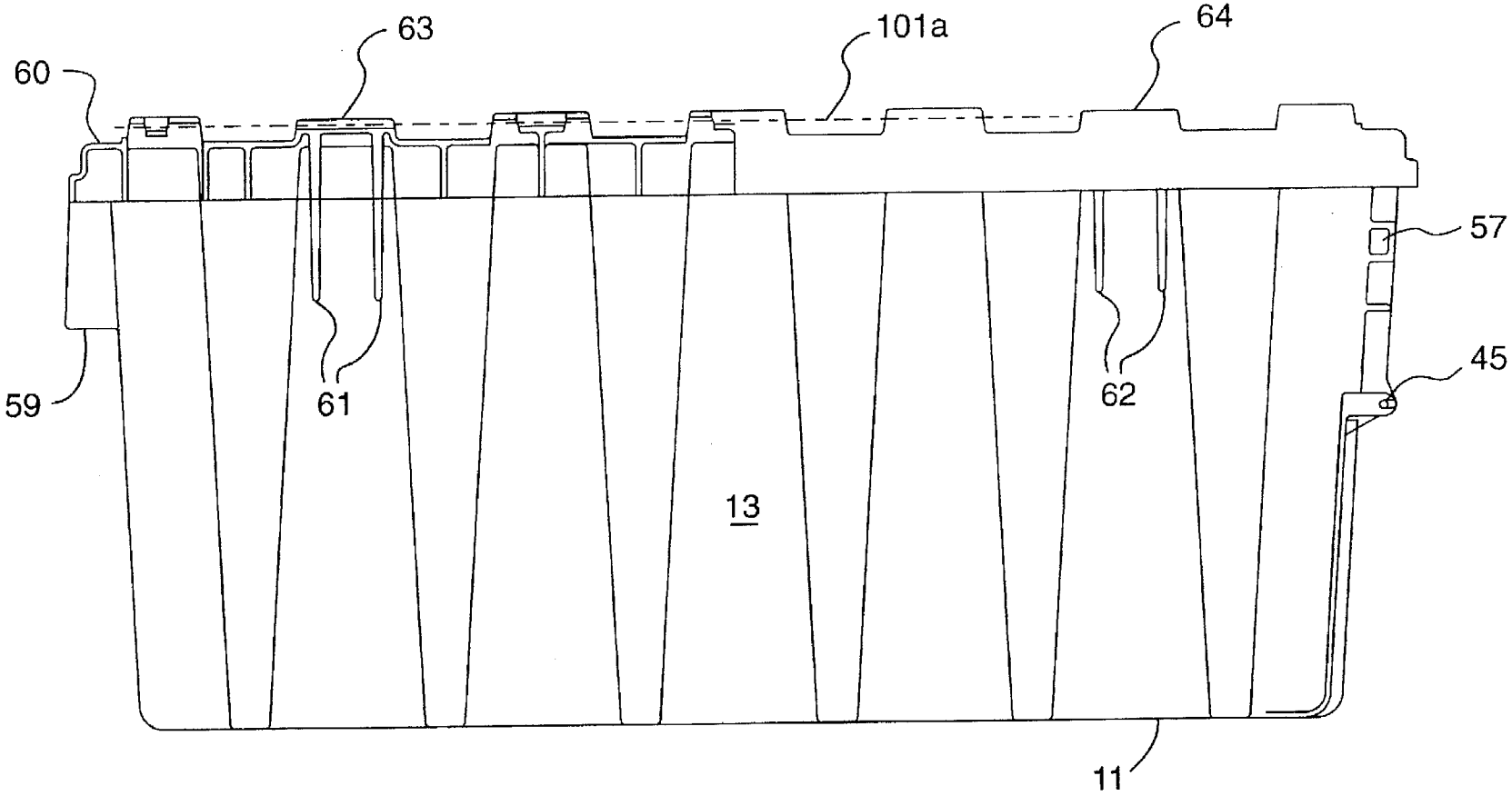
FIG. 6 is a side view of the container shown in FIG. 1 without lids and without the drop gate.
Figure 7:
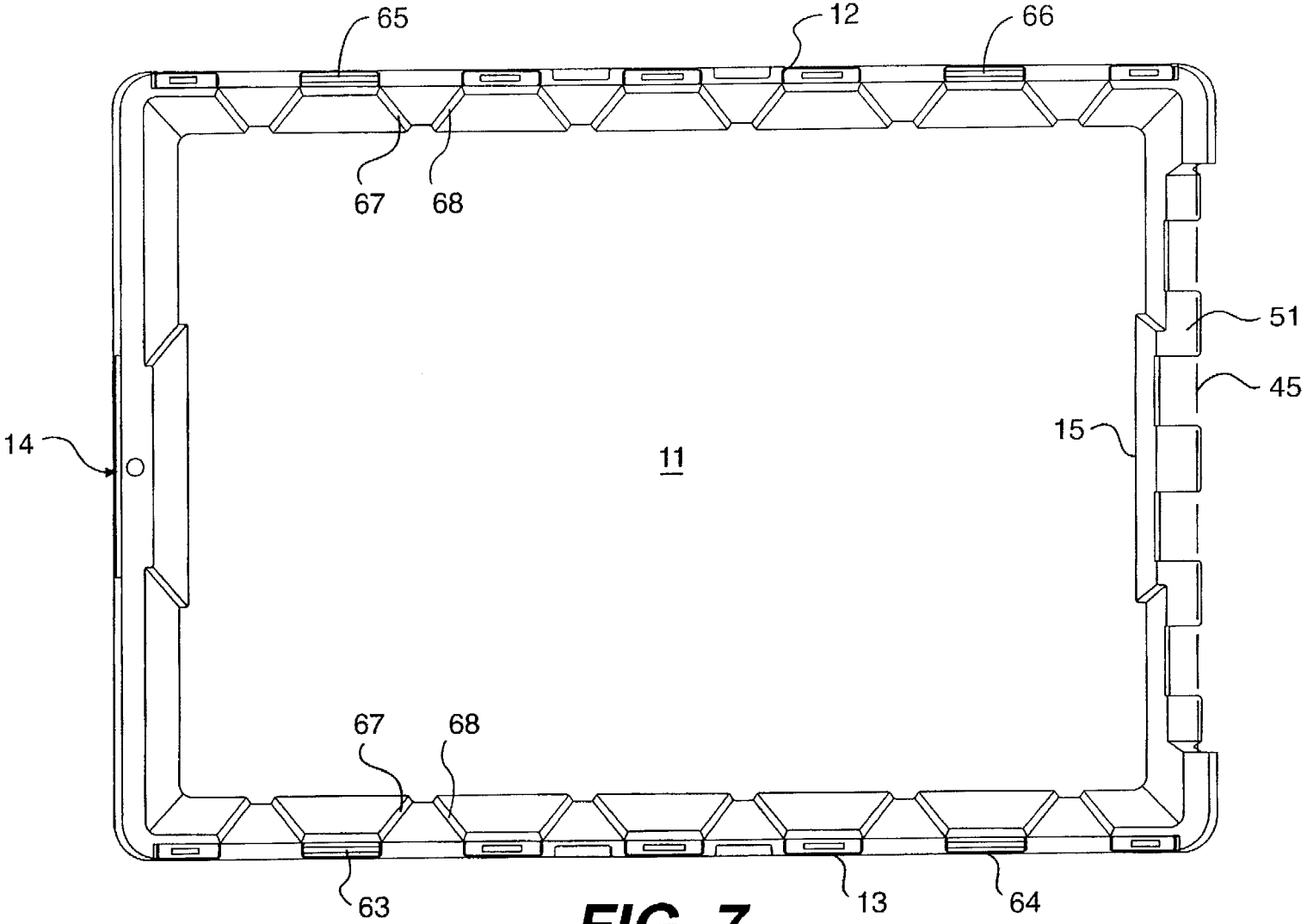
FIG. 7 is a top plan view of the container shown in FIG. 1 without the lids and drop gate attached.

FIG. 5 shows an end view from end wall 15 of the preferred embodiment of the container constructed according to the present invention. FIG. 6 shows a side view thereof, without the lids attached. As shown in these figures, hinge pin supports 51 are molded into end wall 15 along the bottom edge 52 of opening 50. The sides 53 and 54 of the opening 50 have reinforcement flanges 55 and 56, respectively. Also, pockets 57 and 58 are provided that are adapted to receive a latch component of drop gate 40, as will be explained in greater detail hereinafter. The axis 45 of the hinge pin is shown in FIG. 7 and projects outwardly far enough away from the end wall to permit 180° rotation of the drop gate.

For nesting, the end wall 14 has a plurality of nesting stops 59, only one of which is shown, that engage with a top flange area 60. Further, the side walls have nesting stops 61 and 62 along side wall 13, as shown nesting 6, and similar nesting stops on opposite side wall 12, as shown in FIG. 5. Nesting stops 61 and 62 engage flats 63 and 64 formed on top of the hinge pin supports and flats 65 and 66 formed on opposite hinge pin supports on side wall 12, respectively, as shown in FIG. 7 Since the top edge of flats 63 and 64 are shown along side wall 13 (FIG. 6) to be raised with respect to top flange 60, nesting stops 61 and 62 are similarly raised with respect to nesting stops 59 so that the nesting depth is even. At the end wall 15, nesting stops are not provided so that nesting can occur whether or not drop gate 40 is open or closed. Further, as shown in FIG. 7, reinforcing ribs 67, 68 in the side walls of the container are tapered with respect to one another for guiding containers into a nested stack.

Figure 8A:
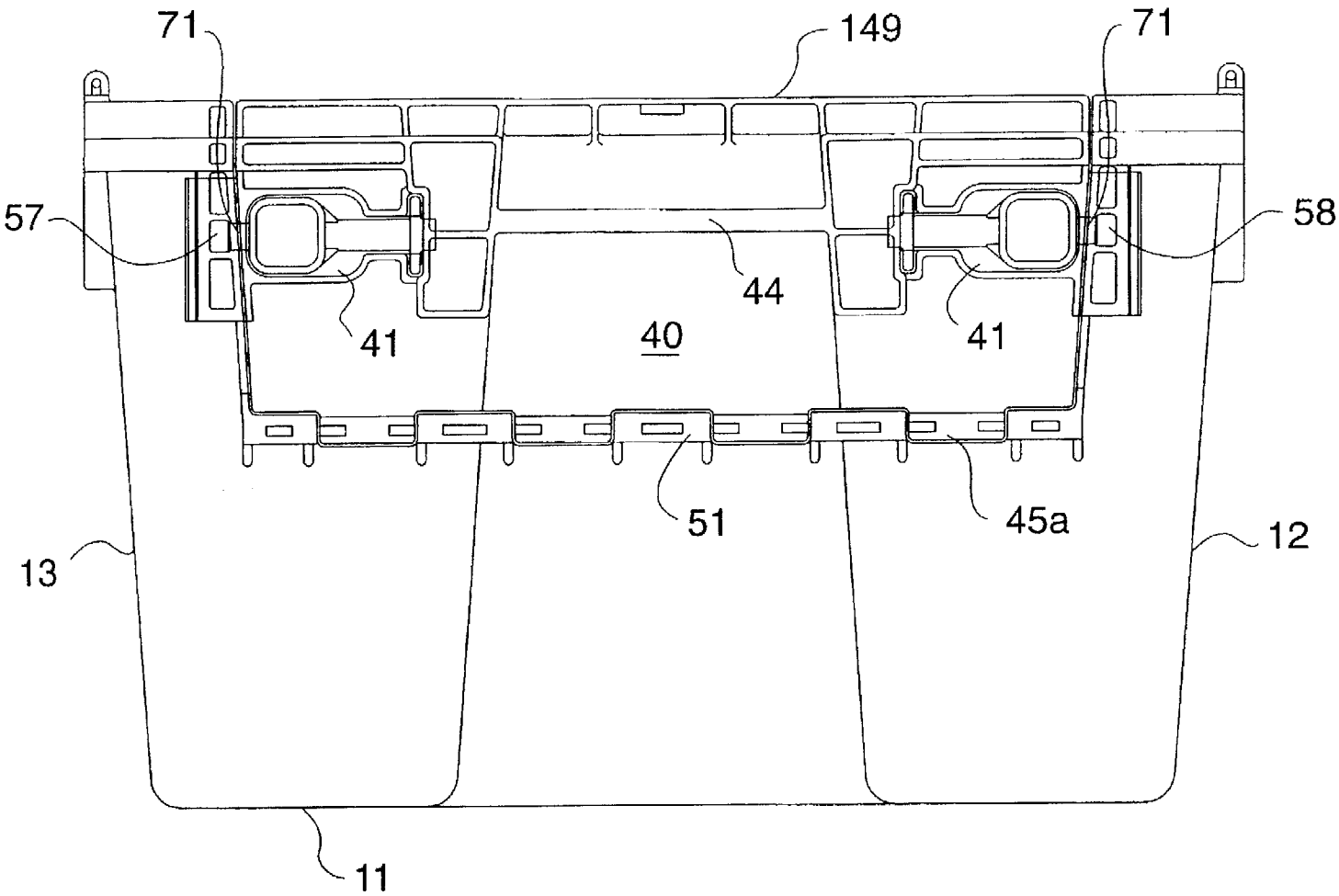
FIG. 8(*a*) is a detailed end elevational view of the container, without lids, with the drop gate, as shown in FIG. 3, further shown with latches for securing the drop gate in the closed position.
Figure 8B:
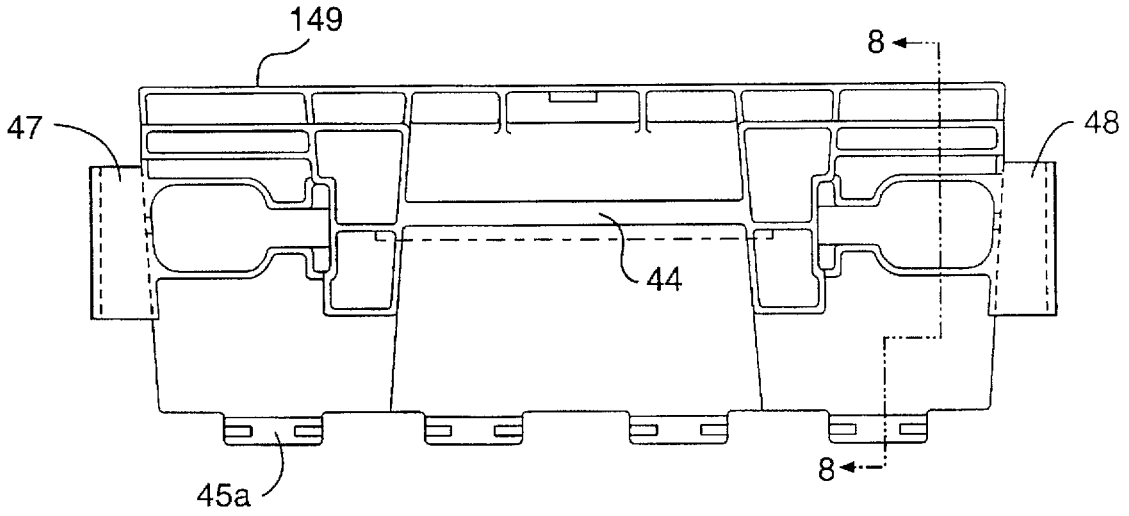
Figure 8C:
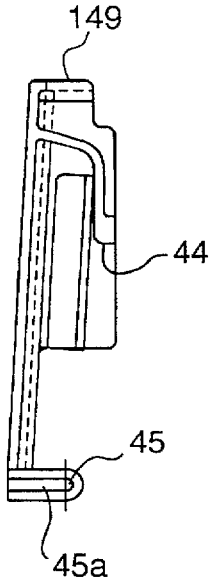

FIG. 8(*a*) is a detailed view, similar to FIG. 3, showing the drop gate 40 hinged to opening 50 in side wall 15 of container 10. As shown in FIG. 8(*a*), the drop gate 40 is retained in the fully closed position by latches 70 having protrusions 71 that respectively engage the pockets 57, 58 formed in sides 53, 54 of the opening 50. Latches 70 are received in latch receiving areas 41, as shown in FIG. 8(*b*). The latches are resiliently urged outwardly and can be urged inwardly to slide projections 71 out of pockets 57, 58 for lowering the drop gate. For handling of the container by the end walls, drop gate 40 also has a handle 44 molded in the lid portion thereof, particularly as shown in FIG. 8(*c*). Further, drop gate 40 has hinge pin supports 45*a* that engage with hinge pin supports 51 for receiving therein the hinge pin, not shown.

Figure 9:
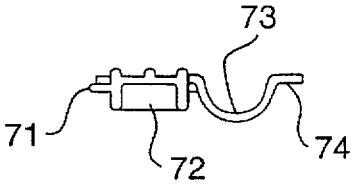
FIG. 9 is a side view of the latches shown in FIG. 8(*a*)

FIG. 9 shows an edge view of latch 70. A finger/thumb hole 72 is provided for operation of the latch and is connected to a bowed plastic member 73 that provides a predetermined resilient force in the direction tending to maintain projection 71 in the respective pockets 57 and 58 of the end wall 15. The tips of the projection 71 are angled to guide the projection over the edge of the pockets during closing of the drop gate. Opposite end 74 of latch 70 is "T" shaped, as shown in FIG. 8(*a*), and is thereby held in place in the latch receiving area 41 of the drop gate. Additionally, drop gate 40 has outwardly spaced return flanges 47 and 48, respectively, that overlap the reinforcing flanges 55 and 56, shown in FIG. 5. These flanges protect the projections 71 from being damaged during operation of the drop gate.

Figure 10:
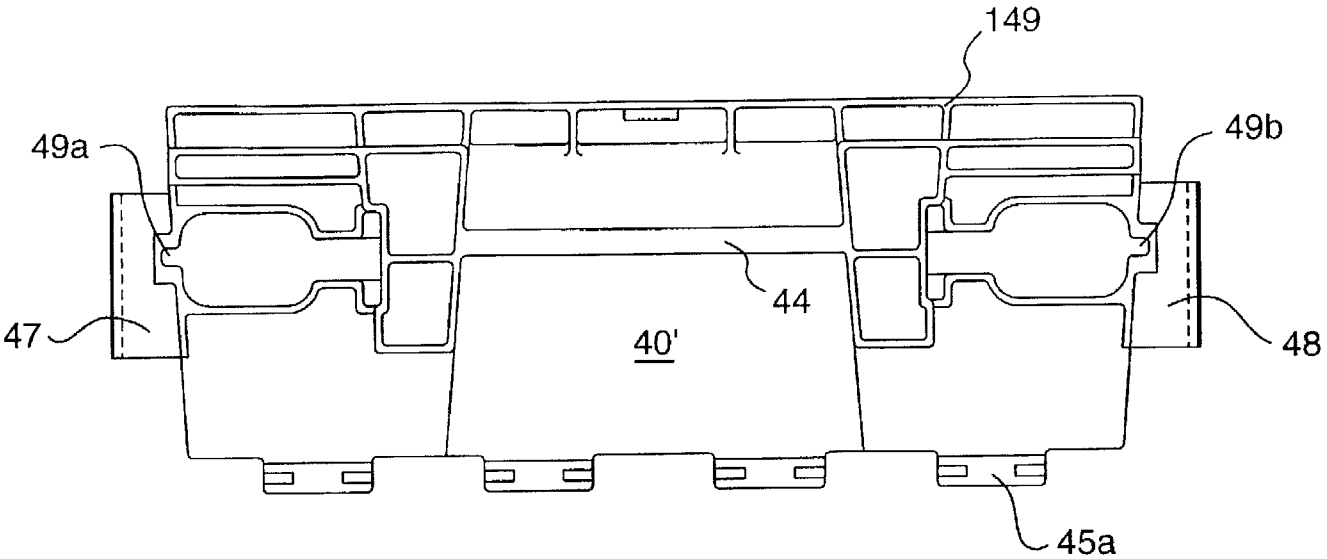
FIG. 10 is an elevational view of a drop gate according to a modification of the embodiment shown in FIG. 8(*a*)
Figure 11:
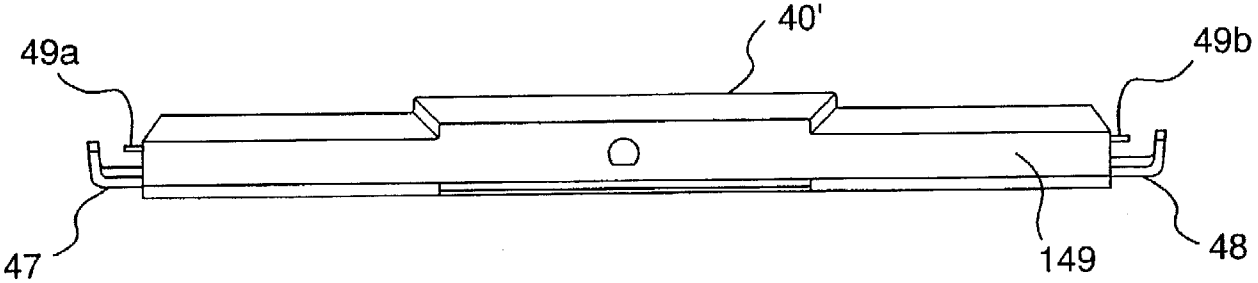
FIG. 11 is a top view of the drop gate shown in FIG. 10.
Figure 12A:
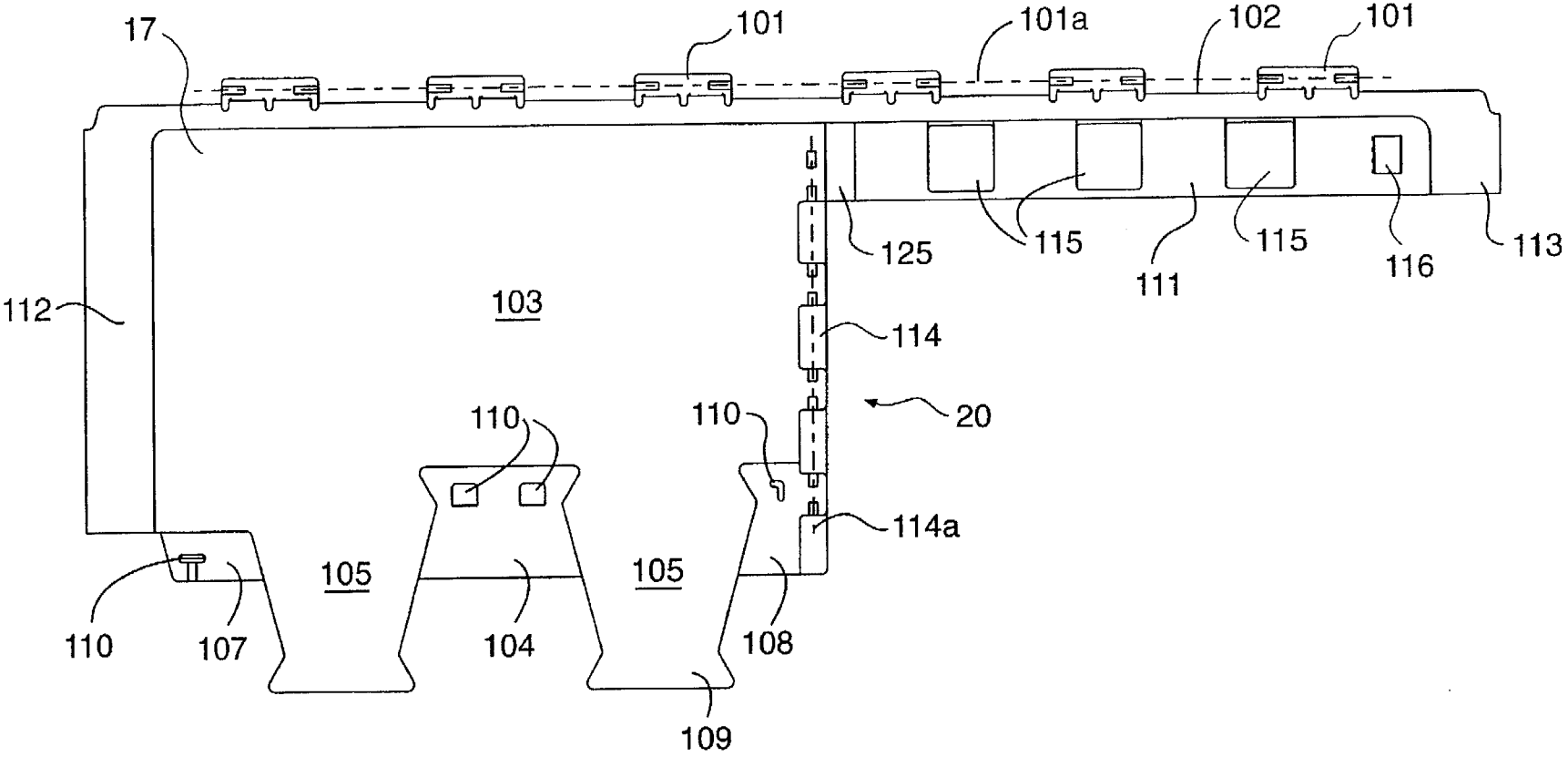
FIG. 12(*a*) is a plan view of the right full lid piece shown in FIG. 1.
Figure 12B:
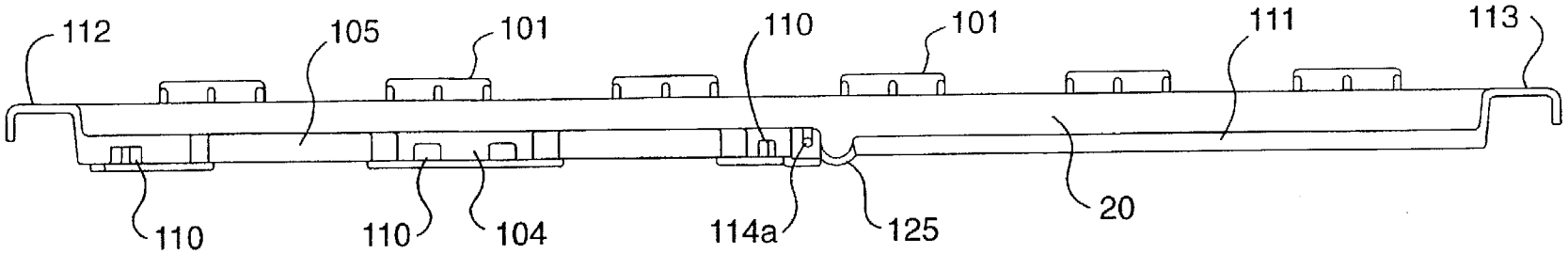
Figure 12C:
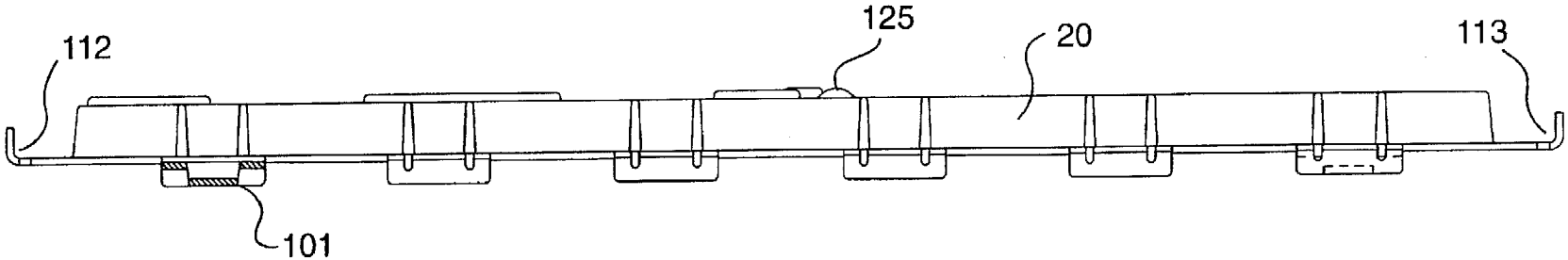
Figure 13A:
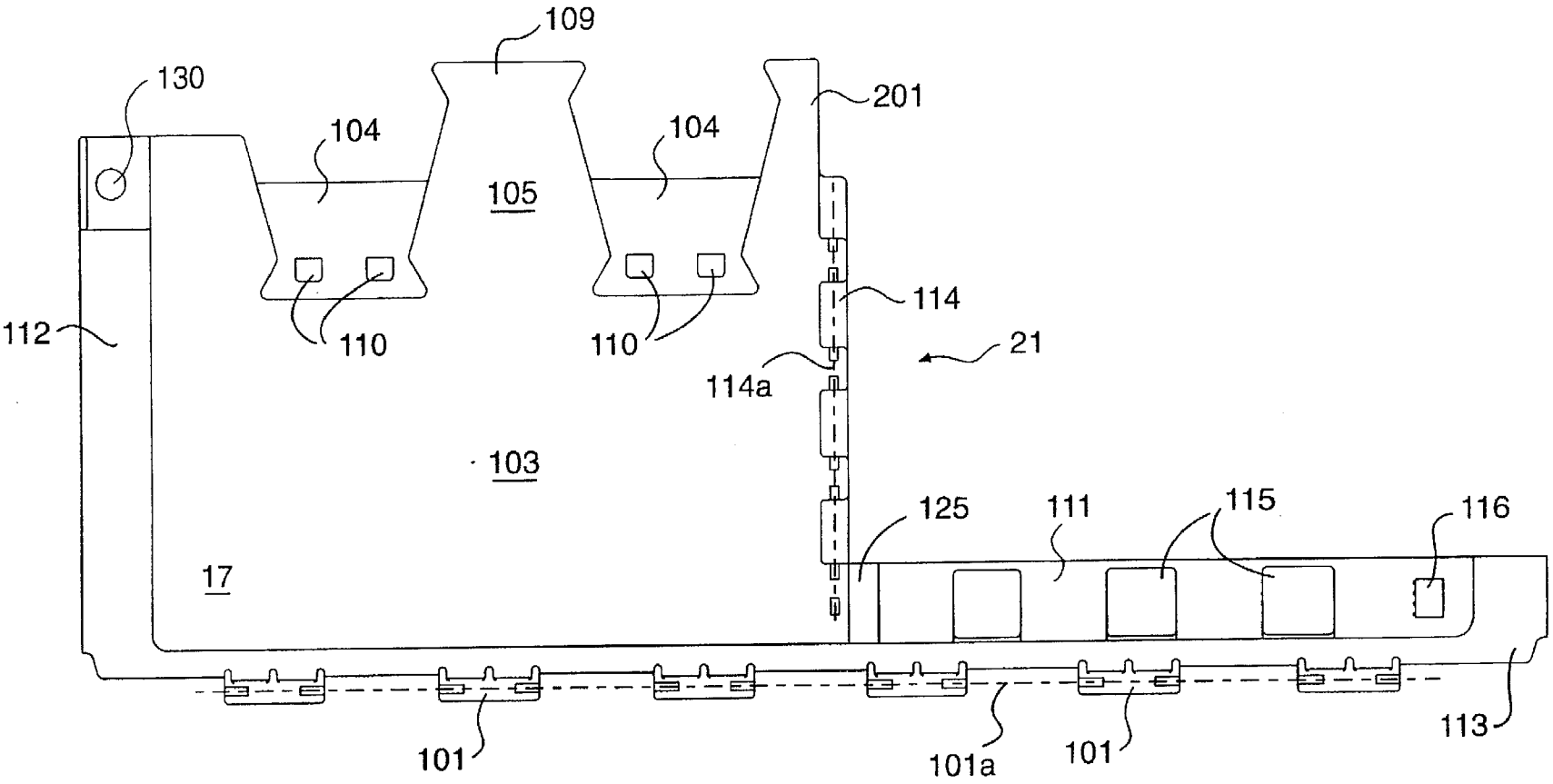
FIG. 13(*a*) is a plan view of the left full lid piece shown in FIG. 1.
Figure 13D:
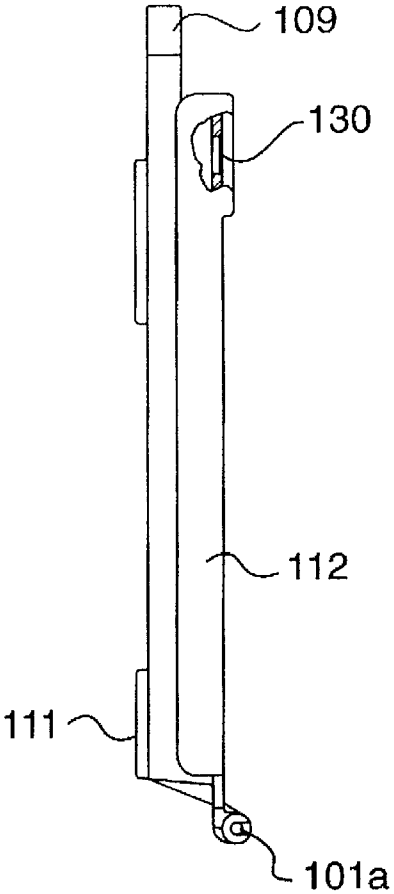
Figure 12D:
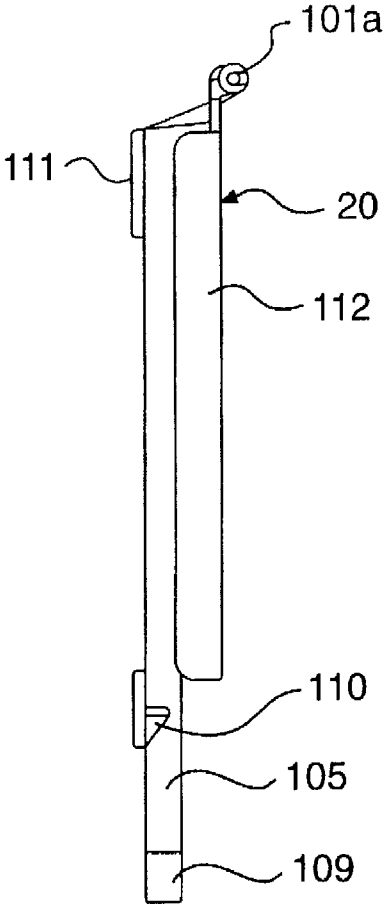
Figure 13B:
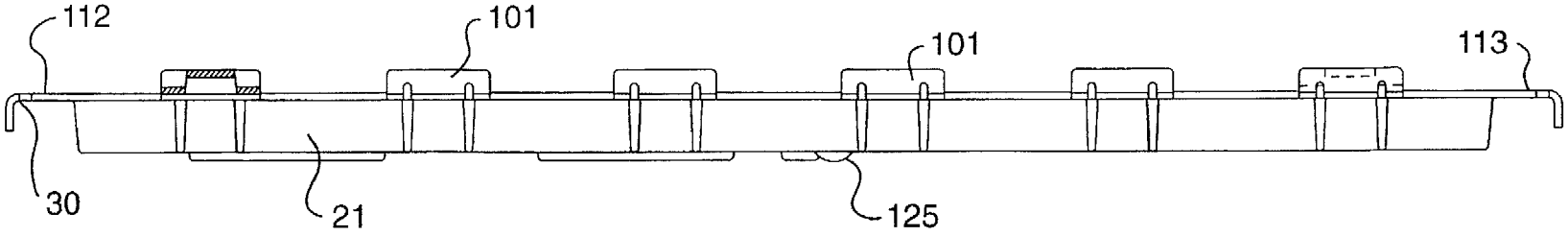
Figure 13C:
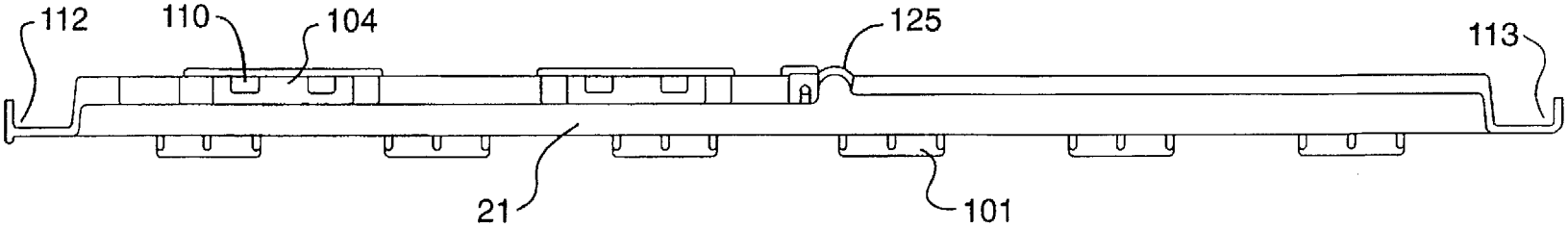

FIG. 10 shows a modification to the drop gate construction shown in FIG. 8(*b*). Whereas the drop gate of FIG. 8(*b*) requires latches 70 to maintain the drop gate in the fully closed position, drop gate 40' shown in FIG. 10 has built in resilient flanges 49*a* and 49*b* that depend from the sides of the drop gate in cantilevered fashion to provide the resilience necessary to maintain the projections respectively in pockets 56 and 57. FIG. 11 shows a top view of the drop gate constructed according to FIG. 10, the details of which are the same as drop gate 40 shown in FIG. 8(*b*), with the exception of the projections 49*a* and 49*b*.

As shown in FIG. 1, lids R and L are attached by hinges 22 and 23 to side walls 12 and 13, respectively. FIGS. 12(*a*)–12(*d*) show detailed views of the full lid piece 20 of lid R. Hinge pin supports 101, the details of which are shown in section in FIG. 12(*c*), are molded along the hinged end 102 of full lid piece 20. Hinge pin supports 101 extend the full length of the lid piece adjacent side wall 12 and mate with corresponding hinge pin supports at the upper end of the side wall 12, in a conventional manner to form a hinge axis 101*a*. A main top portion 103 extends outwardly from hinged end 102 to cover one quarter of the open top of container 10. At the free end 104 opposite hinged end 102, fingers 105 and recesses 106 (including half recesses 107 and 108) are provided that mate with corresponding structure in full lid piece 21 of lid L when the lids are closed. The fingers 105 have a wedge shaped end 109 that mates in a correspondingly shaped part of a recess. In addition, upstanding ribs or flanges 110 are provided in the recesses to engage the terminal portions of the fingers. This prevents separation between engaging fingers and recesses when a load is placed on the lids in their fully closed position.

Figure 14A:
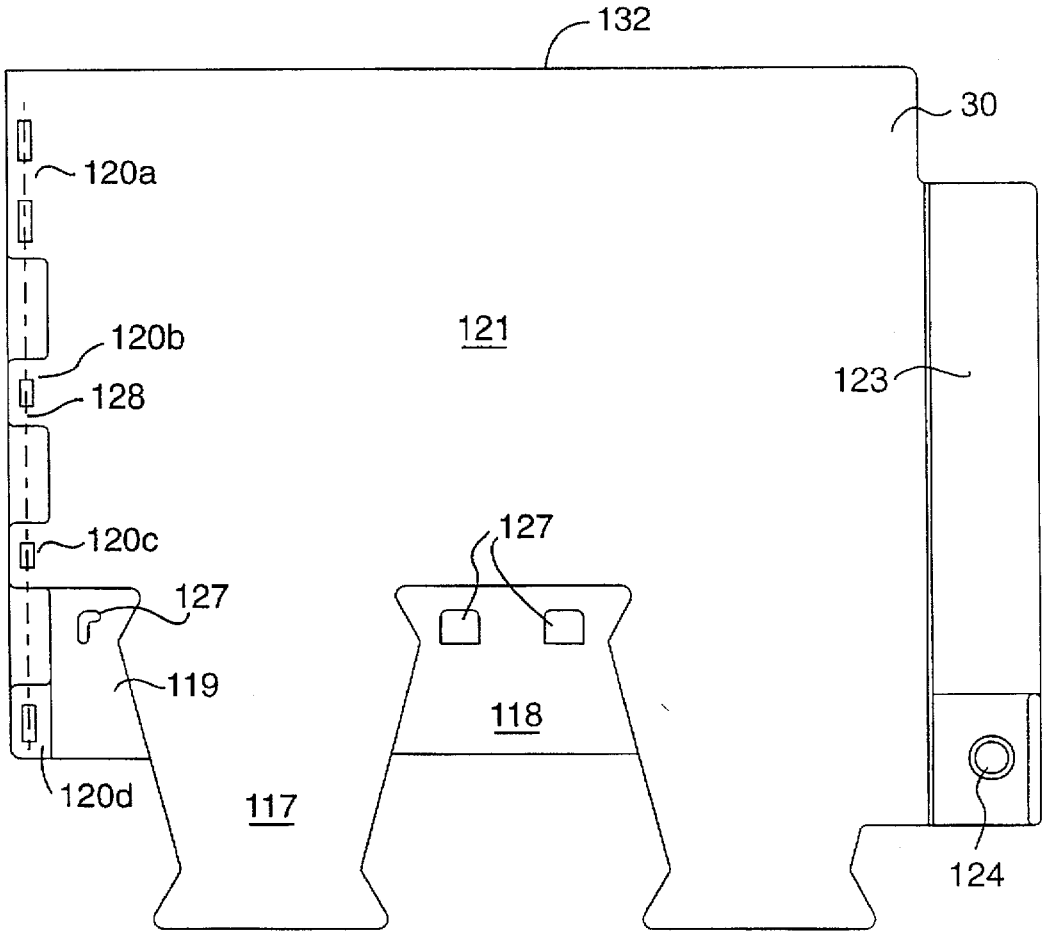
FIG. 14(*a*) is a plan view of the right half lid piece shown in FIG. 1.
Figure 14B:
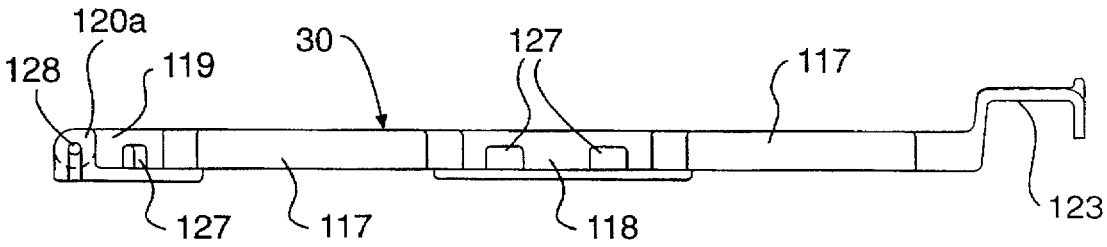
Figure 14C:
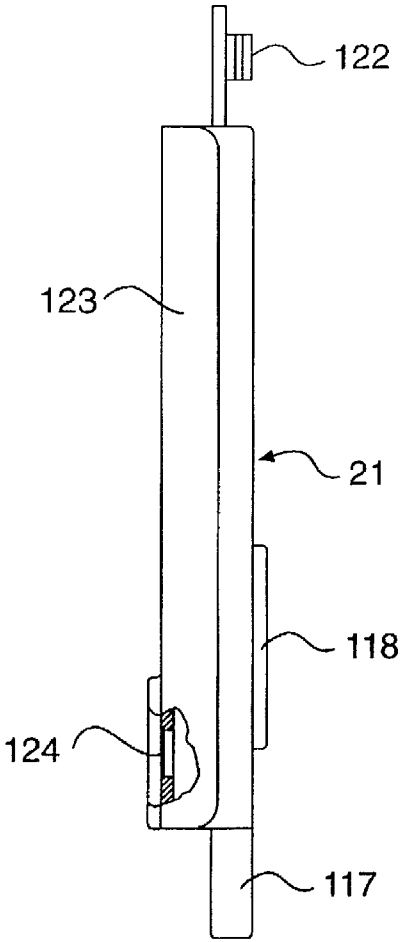

Adjacent main top portion 103 and extending into the area of the open top of container 10 is a support flange 111 that provides side support for a free end 132 (FIG. 14(*a*) of adjacent half lid piece 30. Along the sides of lid piece 20 are return flanges 112 and 113, respectively. Return flange 113 provides additional support to support flange 111 to prevent bending. The portion of lid piece 20 that steps down from return flanges 112 and 113, and from the hinge pin supports 101, forms the recessed portion 17 of the lid, as shown in FIG. 12(*b*). As shown in FIG. 12(*d*), the support flange 11 is recessed with respect to recessed portion 17 by the thickness of the lid piece 30 to make the recessed portion 17 uniform across both lid pieces 20 and 30 when they are joined together in a closed position.

Half lid piece 30 is hinged to full lid piece 20 by a hinge member 80 having a first pin that passes through hinge pin supports 114 along a first hinge axis 114*a* shown in FIGS. 12(*a*) and 12(*b*). Along support flange 111 are formed pocket structures 115*a* that receive correspondingly formed post structures 115*b*, as shown in FIG. 4, in half lid piece 30. These engaging post and pocket structures prevent separation between the half lid piece 30 and the support flange 111 when a load is placed on the lids, for example during stacking. Alternatively, as shown in FIG. 1, the post and pocket structure can be replaced with interlocking rib and groove structure in order to achieve the same function, according to a preferred embodiment.

FIG. 4 shows that hinge member 80 is used between the full lid pieces and the half lid pieces to provide two hinge pins for connecting the lid pieces. This allows 180° ro tation of lid piece 30, including movement of the hinge axis passing through half lid piece 30 to be achieved so that it lays as flat as possible on lid piece 20 when folded back to an open position.

Figure 16B:
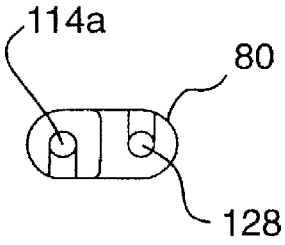
FIG. 16(*a*) is a plan view of a hinge member used in joining the full and half lid sections shown in FIG. 1.
Figure 16A:
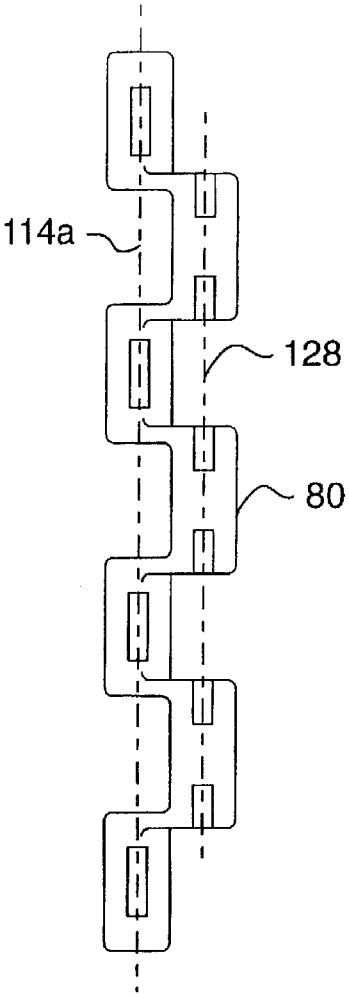

FIGS. 16(*a*) and 16(*b*) show a plan view and end view, respectively, of hinge member 80 that is used to join the respective hinge supports of lid pieces 20 and 30, and also lid pieces 21 and 31. The hinge member permits two side by side hinge pins to be used in forming the hinge joint between the respective full and half lid pieces.

FIGS. 14(*a*)–14(*c*) show the half lid piece 30 in detail. In particular, lid piece 30 has fingers 117, a recess 118, a half recess portion 119 and ribs 127 in the recesses. Half recess portions 108 and 119 together form a full recess that spans the hinge joint between the full and half lid pieces. The fingers and recesses of both lid pieces 20, 30 work together with corresponding structure formed in lid pieces 21, 31 to enable the free ends (opposite the hinged ends) of the lids to be closed in engagement with each other.

The hinged end of lid half piece 30 has hinge pin supports 120*a*–120*d* forming a second hinge axis 128 (in addition to hinge axis 114*a*). Hinge pin support 120*a* has an outer periphery that is semicircular, as shown by a dashed line in FIG. 14(*b*), that is adapted to be received in a hinge pin support recess 125 formed in lid piece 20 as shown in FIG. 12(*a*) and 12(*b*). This combination of structure provides smooth rotation between the opened and closed positions of the half lid piece 30, which is required because of the intermediate hinge member 80.

In the closed position, main top portion 103 of lid piece 20 is coplanar with lid portion 121 of lid piece 30. As shown in FIG. 14(*c*), a pair of dependent flanges 122 extend downwardly from the side edge of lid piece 30 to engage a through hole 116 to provide a snap fit that secures lid piece 30 into engagement with support flange 111 of lid piece 20. When the two pieces 20, 30 are snap fit together, the lid pieces work together to open and close like a conventional tote lid. In the closed position, a return flange 123 of lid piece 30 functions like return flange 112 of lid piece 20 to overlap the upper end 149 of drop gate 40. Additionally, as shown in FIGS. 14(*a*) and 14(*c*), a security tie aperture 124 is provided in alignment with a similarly formed aperture in upper end 149 of drop gate 40.

Figure 15C:
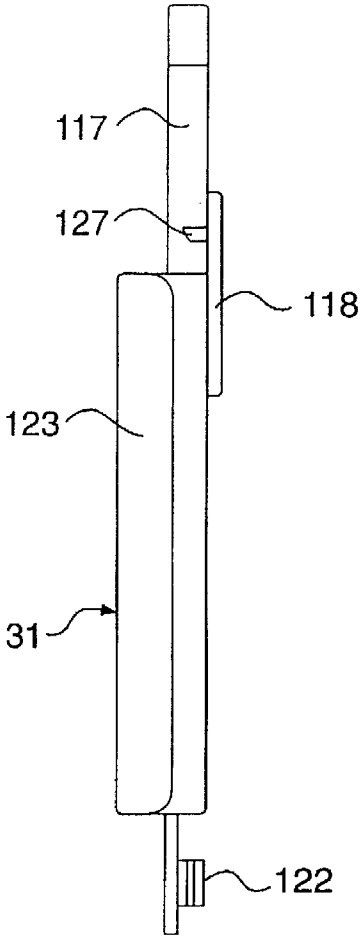
FIG. 15(*a*) is a plan view of the left half lid piece shown in FIG. 1.
Figure 15A:
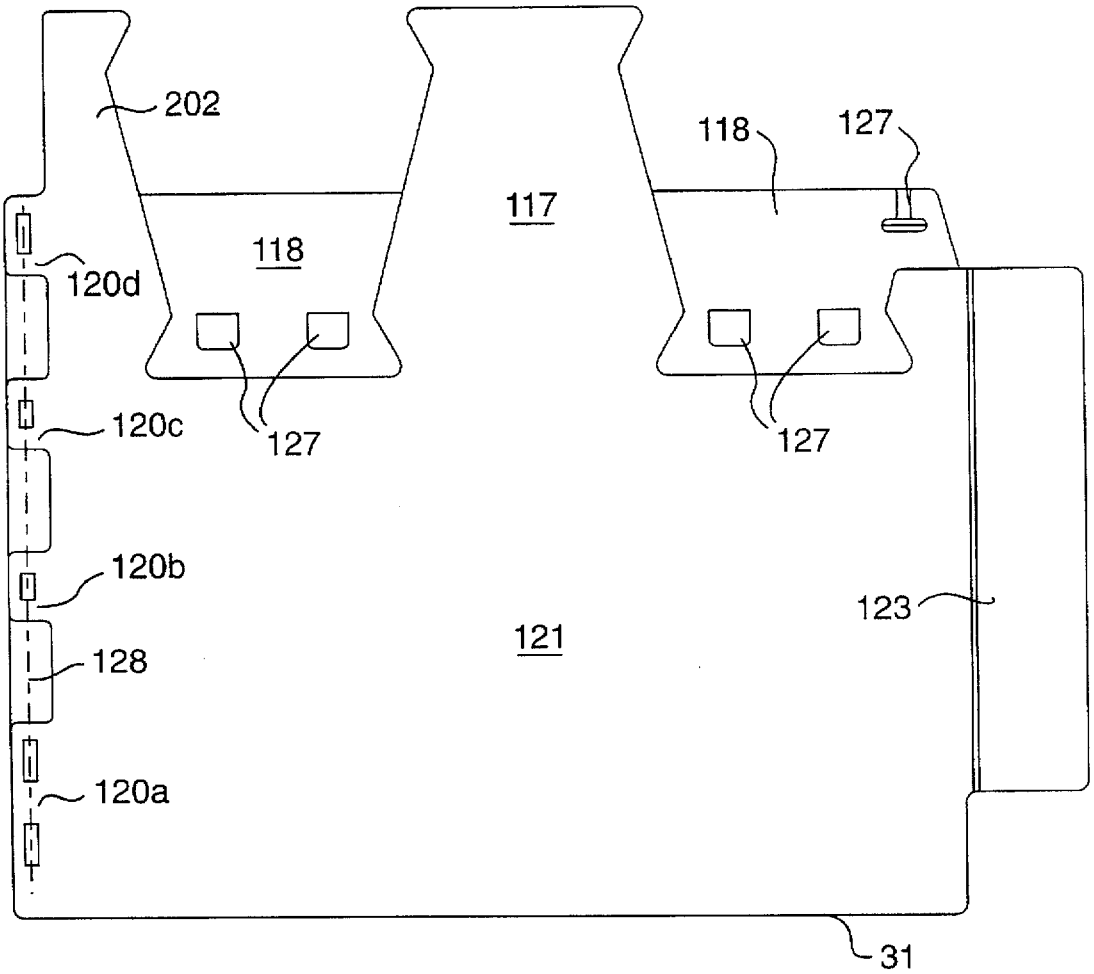
Figure 15B:
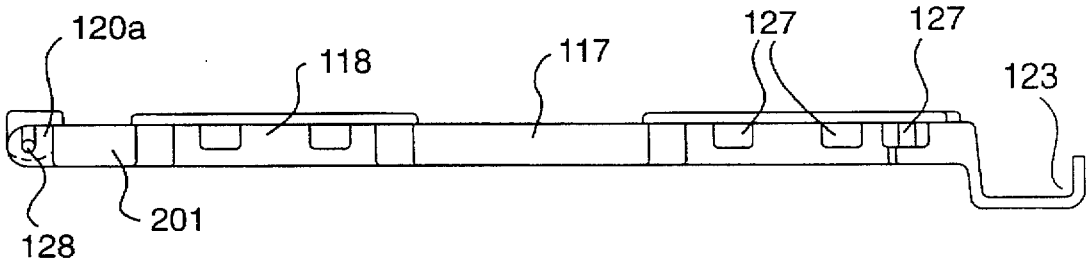

In FIGS. 13(*a*)–13(*d*), the full lid piece 21 of lid L is shown in detail and in FIGS. 15(*a*)–15(*c*), the half lid piece 31 is shown in detail. The structure shown in these figures that is in common with FIGS. 12(*a*)–12(*d*) and 14(*a*)–14(*c*), respectively, is shown with common reference numbers. The main difference between the lid pieces 20 and 21 is that they are in mirror image of one another. Further, lid piece 21 has a one half finger portion 201 that engages the one half recess portion 108 on one side of the hinge joint between lid pieces 21 and 31. Another one half finger piece 202 is formed in lid piece 31 that engages the similarly shaped recess 119 in lid piece 30. The combination of one half finger pieces 201, 202 and similarly shaped one half recesses or pockets 108 and 119 provide a strong support for the mid expanse of the lids R and L. Thus, although each lid R and L have a hinge joint extending across the lid, the lid has structural integrity and can withstand stacking loads placed on the lids, normally encountered when several of the containers with their lids in the closed position are stacked on one another. Also provided in full lid piece 21 is a aperture 130 that is adapted to receive a security tie, for example.

Although the present invention has been described with respect to the combination of container and lids, the lids can be used with containers of standard totes that do not have a drop gate 40. Use of a container having a drop gate, however, is preferred because greater access can be gained to the interior of the container with the drop gate opened and the half lid pieces folded back to their opened position. This makes the container useful as a shelf box in a flow rack system.

The combination of container and lid according to the present invention is also useful as a standard distribution tote for shipping orders filled at the distribution center to retail outlets. At the retail outlets, the container can then be opened and used in the same way as standard distribution totes, for displaying merchandise, or removing merchandise and displaying the merchandise on shelves.

In a preferred embodiment of the invention, the container can also be used to replace the bulk shipping containers used by suppliers and vendors to ship goods to a distribution center. In this way, goods to be selected in a flow racking or order picking system can be received at the distribution center in the containers, and the containers can be opened to the extent that the half lid pieces are folded back to their open position overlaying the full lid pieces, and with the drop gates of the containers opened, the combined container and lids of the invention can be used as shelf boxes directly without unpacking the goods as they are received from the suppliers or vendors. Then, once the orders are selected, the container can be used for shipping the selected goods to the retail outlets. In this way, the distribution system from supplier to retail outlet is managed using only one container, in three different ways.

Preferably, the container and lids, including the lid pieces and hinge members, are all molded of plastic by injection molding the individual pieces, as shown in the figures. Accordingly, assembly of the container with the lids requires inserting the hinge pins through the respective hinge pin supports and inserting the optional latch members in the drop gate. Thus, an economical container with lids serving many functions can be constructed according to the invention with a minimum amount of labor cost occurred in the assembly of the container and lids.

Although preferred embodiments of the invention have been disclosed in the foregoing description of the invention, other modifications are possible and would be known to those having ordinary skill in the art. Additionally, further modifications, additions and alterations are included within the scope of the invention, as defined in the claims.

I claim:

1. A lidded container, comprising:

said container having a bottom wall, opposed side walls and opposed end walls, said side and end walls extending upwardly from said bottom wall and terminating in upper end portions forming a perimeter around an open top of said container;

opposed first and second lid portions having respective hinged ends connected to said upper end portions of said side walls by first and second hinges, said first and second lid portions having free ends opposite said hinged ends;

opposed third and fourth lid portions having respective hinged end portions connected to respective sides of said first and second lid portions, respectively, and along a hinge axis extending between said side walls by respective third and fourth hinges disposed approximately midway between said end walls so that said third and fourth lid portions swing between a first position wherein said third and fourth lid portions are substantially coplanar with said first and second lid portions and a second position wherein said third and fourth lid portions rotate about said hinge axis approximately 180° to overlay said first and second lid portions; and said third and fourth lid portions when in said first position further having free ends that together with said free ends of said first and second lid portions have means for engaging one another in a closed position for covering said open top of said container wherein both said third and fourth lid portions can be opened from one of said end walls and moved from said first position to said second position for opening approximately one half of said lidded container.

2. A lidded container according to claim 1, further comprising said one end wall having an opening and a drop gate covering said opening, said opening having an upper end portion and opposed side portions and said drop gate having hinge means along a bottom end portion hinged to said upper end portion of said opening so that said drop gate swings between an open position wherein said drop gate hangs down in front of said one end wall and a closed position.

3. A lidded container according to claim 2, wherein said sides of said drop gate respectively have means for engaging said sides of said opening for retaining said drop gate in said closed position.

4. A lidded container according to claim 2, wherein said drop gate forms part of said one end wall with an upper end of said drop gate in common with said upper end of said one end wall and wherein said third and fourth lid portions have a return flanges along ends opposed to said hinged ends for engaging said upper end of said drop gate.

5. A lidded container according to claim 1, wherein said third and fourth lid portions have a dimension extending between said side walls that is approximately equal to a dimension of a recessed portion extending between said side walls of said first and second lid portions.

6. A lidded container according to claim 1, wherein said third and fourth lid portions have a top area that fits within a recessed top area of said first and second lid portions when said third and fourth lid portions are in said second position.

7. A lidded container according to claim 1, wherein said first and second lid portions further having support flanges that engage side ends of said third and fourth lid portions along said side walls for supporting opposed sides of said third and fourth lid portions, respectively when said third and fourth lid portions are in the said first position.

8. A lidded container according to claim 7, further including means for engaging said support flanges and said third and fourth lid portions to retain said third and fourth lid portions in said fully closed position.

9. A lidded container according to claim 1, wherein said first, second, third and fourth lid portions together form a recessed lid area having a dimension substantially equal to an outer dimension of a bottom wall of a like said container for supporting stacking of like said lidded containers.

10. A lidded container according to claim 1, wherein, in an open position of said lidded container, like said lidded containers in said open position can be stacked in a nested relationship.

11. A lidded container according to claim 1, wherein said perimeter of said container is covered by a continuous return flange formed from said first, second, third and fourth lid portions.

12. A lidded container according to claim 1, wherein said means for engaging respectively includes interfitting fingers and pockets.

* * * * *